US006926469B2

(12) United States Patent
Janesky

(10) Patent No.: US 6,926,469 B2
(45) **Date of Patent: *Aug. 9, 2005**

(54) CRAWLSPACE ENCAPSULATION SYSTEM WITH RESEALABLE ACCESS OPENINGS

(76) Inventor: Lawrence M. Janesky, 11 Fawn Meadow La., Huntington, CT (US) 06484

( * ) Notice: Subject to any disclaimer, the term of this patent is extended or adjusted under 35 U.S.C. 154(b) by 72 days.

This patent is subject to a terminal disclaimer.

(21) Appl. No.: 10/341,921

(22) Filed: Jan. 14, 2003

(65) Prior Publication Data

US 2004/0136790 A1 Jul. 15, 2004

(51) Int. Cl.[7] ..... C09K 17/00
(52) U.S. Cl. ..... 405/270; 405/229
(58) Field of Search ..... 405/270, 229; 52/169.5, 169.14, 741.3, 746.1

(56) References Cited

U.S. PATENT DOCUMENTS 3,808,760 A * 5/1974 Ward ..... 52/220.5
4,184,304 A * 1/1980 Merchant ..... 52/746.1
4,561,232 A * 12/1985 Gladden et al. ..... 52/385
5,040,251 A * 8/1991 Hanford ..... 4/496
5,642,967 A * 7/1997 Swain et al. ..... 405/229
5,927,000 A * 7/1999 Bordes, Jr. ..... 43/124
6,079,150 A * 6/2000 Setikas et al. ..... 43/132.1
6,575,666 B1 * 6/2003 Janesky ..... 405/270

* cited by examiner

*Primary Examiner*—Heather Shackelford
*Assistant Examiner*—Lisa Saldano
(74) *Attorney, Agent, or Firm*—Perman & Green, LLP

(57) ABSTRACT

An improvement in an installation having a continuous water-impervious liner forming a barrier against the entry of water vapor and insects such as termites from the sub-soil into a crawlspace. According to the present invention, the water-impervious liner is provided with one or more access openings to the sub-soil, each covered with a flap, patch or cover which is openable to provide access to the sub-soil, and which is resealable to restore the water-barrier and/or water vapor-barrier properties of the liner in simple fashion as often as necessary.

3 Claims, 4 Drawing Sheets

CRAWLSPACE ENCAPSULATION SYSTEM WITH RESEALABLE ACCESS OPENINGS

BACKGROUND OF THE INVENTION

1. Field of the Invention

The present invention relates to a modification of the invention disclosed in my depending application U.S. Ser. No. 10/165,458 filed on Jun. 7, 2002 which discloses a novel and efficient system for preventing the entry of ground moisture into so-called crawlspaces of buildings such as homes. Moisture is very damaging to wood structural support members of buildings and is absorbed by such members from the ground and from moist air in contact herewith.

As disclosed in U.S. Ser. No. 10/165,458, the disclosure of which is incorporated herein, many buildings and homes are built without basements, and are elevated a few feet above the ground on support members such as stone, poured concrete or concrete block walls. In many cases the crawlspace between the ground surface and the wooden floor beams or joists of the house is at a level below the level of the surrounding soil, or below the level of saturated soils in wet weather, so that water flows into and is absorbed up through the floor of the crawlspace, usually a dirt surface, from adjacent ground areas of higher elevation and up from the sub-soil. Such water is drawn into the headroom of the crawl space in the form of water vapor and penetrates the wooden structural members of the building, causing wood rot, mold, odors, attraction of ants and other insects, rodents etc. Insects, particularly subterranean termites, cause tremendous amount of damage and loss of property value to wooden homes and businesses, especially in certain areas of the United States. They migrate up from below ground over foundations, support members, conduits, etc., in contact with the ground, in search of moist wooden structural members which they infestate and digest causing eventual disintegration and collapse.

2. State of the Art

Copending U.S. Ser. No. 10/165,458, filed Jun. 7, 2002, discloses a novel and effective system for encapsulating a crawlspace against the entry of sub-soil water vapor, mold and insects through the crawlspace floor and walls and into wooden structural members. The system of the copending application comprises applying over the dirt floor of the crawlspace a continuous sealed plastic film barrier layer, and extending the barrier film vertically-upwardly to cover and seal the interior peripheral walls enclosing the crawlspace to an elevation at least slightly greater than the elevation of the ground in contact with the exterior surfaces of the peripheral walls and preferably to the tops of the peripheral walls. This encapsulates the dirt surface of the entire crawlspace against the penetration of external ground water or flood water and also sub-soil water, water vapor and insects such as termites through the plastic barrier film and into the crawlspace atmosphere where they can come into contact with wooden structural members.

While the encapsulation system of copending application U.S. Ser. No. 10/165,458 is completely effective for its intended purpose, it blocks access to the ground covered by the continuous barrier film. Such access is desirable or even necessary in some installations such as to enable gas or water meters to be read or, sewer cleanouts, or more commonly, to enable termite-control stations, such as Sentricon™ containers, to be serviced periodically. The Sentricon™ and other like bait station systems are in widespread use in areas where subterranean termite infestation is common, for the early detection of and control of termites before they migrate into the home or building. Containers are buried beneath ground level and filled with a bait such as wood. The containers are opened and inspected periodically for the presence of termites, which can enter the container and eat the wood. If termites are detected, the moist wood is replaced with termite-control chemicals, and the procedure is repeated to keep the termites under control.

While the crawlspace encapsulation barrier film prevents the entry of subterranean termites through the film into the crawlspace, it does not prevent underground colonies of termites from growing and migrating beneath ground beyond the crawlspace and/or up through hollow block walls into adjacent areas of the home or building. The Senticon™ and similar bait-and-kill systems require the burial of a plurality of containers, spaced around the entire periphery of the home or building, including any crawlspace for maximum effectiveness. Also, other termite treatments involve spraying the dirt surface of the crawlspace with chemicals every 5 years or so, beneath the barrier layer.

SUMMARY OF THE INVENTION

The present invention relates to an improvement in an installation having a continuous water-impervious liner forming a barrier against the entry of water and water vapor, and insects such as termites from the sub-soil into the crawlspace. In such installations it is often desirable or necessary to have access to the sub-soil, such as for the installation and periodic servicing of insect-control containers, accessing sewer cleanouts, etc., and spraying the dirt surface while preserving the water-barrier properties of the liner.

According to the present invention, the water-impervious liner is provided with one or more access openings to the sub-soil, each covered with a flap, patch or cover which is openable to provide access to the sub-soil and to insect control containers buried therein, and which is resealable to restore the water-barrier properties of the liner in simple fashion as often as necessary.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(s)

Figure 1:
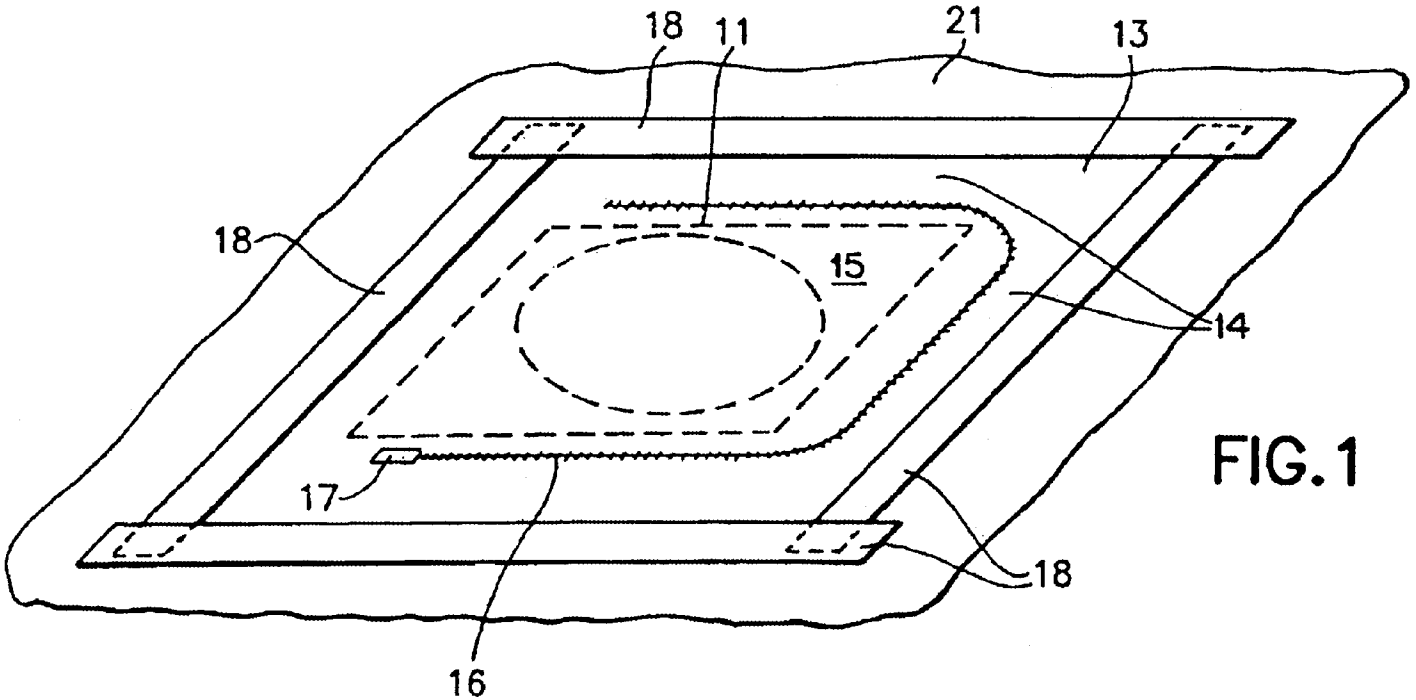
FIG. 1 is a perspective view of a resealable access patch or hatch bonded to a crawlspace liner according to one embodiment of the present invention.

Referring to FIG. 1, the continuous crawlspace liner 21, as illustrated in my application U.S. Ser. No. 10/165,458, now U.S. Pat. No. 6,575,666, is provided in the floor area thereof with spaced openings 10 or underflaps shown by means of broken lines 11 in FIG. 1, to permit access to the soil therebeneath and to insect control containers 12, shown in FIGS. 1, 3 and 4, such as Sentricon™ bait stations to be buried in the soil with their removable covers exposed at or near ground level beneath the liner 21. The invention involves providing the liner with resealable access patches or hatches 13, one for each spaced opening 10 which is formed or cut into the liner 21.

According to one embodiment of the present invention illustrated by FIG. 1, the access openings 10 or underflaps are sealed by means of patches 13 having sealed resealable upper access flaps 15 cut through the patch 13 along three sides to permit the flap 15 to be lifted to expose the under flap 10 and a sufficient area of the soil beneath the flap 10 to permit an insect control container 12 to be buried in the soil with its removable cover exposed at or near ground level to permit the container to be serviced. The invention involves restoring the water-barrier properties of the barrier film 21 while permitting periodic access to the insect control container 12 by applying a water-tight resealable access patch 13 or cover to the liner 21 to surround, enclose and provide a water-tight seal around the opening 10 formed or cut into the liner 21.

In the embodiment of FIG. 1, the access patch 13 comprises a rectangular patch formed of water-barrier material such as plastic film or rubber sheeting having a peripheral marginal area 14 surrounding an interior sealed and resealable water barrier upper flap 15 united to the marginal area 14 along three sides by means of a water barrier plastic zipper 16, which may be a conventional "zip-lock" means, having a pull tab or grip 17, which can be grasped between the fingers and pulled over the zipper 16 to unseal the flap 15 and permit the upper flap 15 to be lifted to expose the opening 10 or under flap 10 to provide access to the insect control container 12 for periodic servicing.

The access patch 13 of FIG. 1 is sealed to the liner 21 by means of a continuous bead of water-resistant adhesive applied to the undersurface of the peripheral marginal areas 14 of the patch and/or by means of strips 18 of a water-resistant adhesive tape such as duct tape as shown in FIG. 1.

Figure 2:
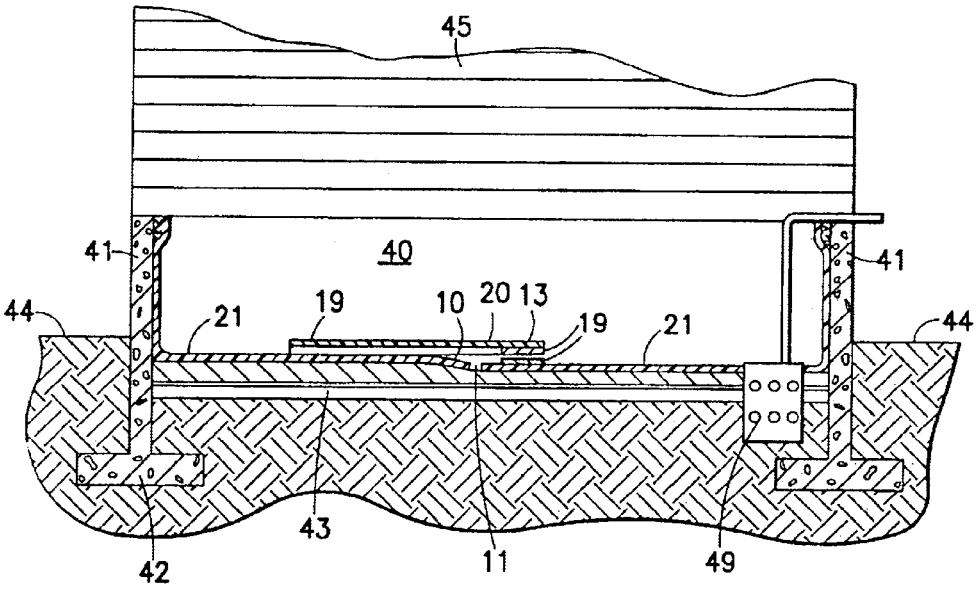
FIG. 2 is a cross-sectional view of crawlspace having a resealable access patch or hatch bonded to the crawlspace liner according to another embodiment of the present invention.
Figure 3:
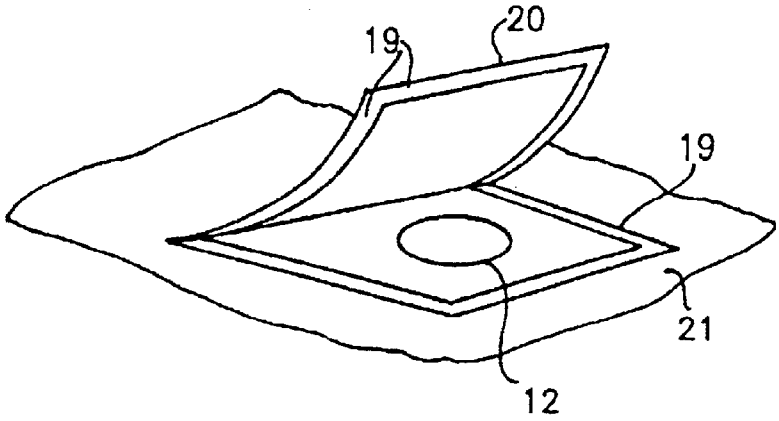
FIG. 3 is a perspective view of a resealable access patch or hatch bonded to a crawlspace liner according to another embodiment of the present invention.

FIG. 2 illustrates a crawlspace 40 of a house 45, and shows another embodiment of an access patch 13, also illustrated in FIG. 3, which is resealably attached to the liner 21 by means of a watertight magnetic tape 19 having an adhesive undersurface which is bonded to the upper surface of the liner 21 to surround the opening or underflap 10 of the liner 21. Referring to FIG. 2, the building 45 is illustrated supported upon peripheral foundation walls 41 such as cement block wall on a peripheral footing 42 buried in the ground beneath the frost line and enclosing the crawlspace 40. Also, an access opening 46, shown in FIG. 2, preferably is provided in the foundation 41, above ground level, or a hatch door is provided in the roof or ceiling to permit access into the crawlspace 40 when necessary. Any air vents present in the crawlspace walls 41 or foundation optionally may be sealed or covered with the crawlspace liner 21 since air circulation is not important after the crawlspace is sealed.

According to an embodiment of the present invention the relatively level floor 47 of the crawlspace 40 may be provided with an inner peripheral water drainage trench 18 or tile filled with aggregate and preferably containing a perforated water drainage conduit 43. Trench 48 may open to a sump pit 49 which, depending upon the slope of the terrain, may contain a sump pump and a discharge pipe 50 which extends up and over the foundation and drains to an external location whenever the water level of the sump pit 49 rises to the activation level of the sump pump. Preferably, the sump pit 49 may comprise a sump reservoir containing a conventional lever-activated sump pump. The incorporation of the drain pit, aggregate-filled water tile and/or sump pit or pump is preferred in installations where excessive amounts of water may be drawn up to the dirt floor 47 of crawlspace 40 and/or may penetrate the cement block foundation 41, above or below ground level, and enter the crawlspace 40 and accumulate beneath the liner 21.

Even in systems in which the floor 47 of the crawlspace 40 is formed of poured concrete, water vapor can penetrate up into the crawlspace 40 at the wall/floor interface or through cracks in the floor 47, from the dirt soil therebeneath. A rectangular sealing flap 20 of water barrier plastic or rubber sheeting is cut with dimensions to match the area of the liner 21 enclosed by the magnetic tape 19 surrounding the opening or underflap 10. A mating adhesive magnetic tape 19 is adhered to the undersurface of the sealing flap 20 around the entire periphery thereof to provide a water-tight magnetic seal between the tape strips 19 adhered to the sealing flap 20. This permits the sealing flap 20 to be lifted out of magnetic engagement with the liner 21 to permit periodic access to the opening or underflap 10 of the liner and to an insect control container 12 buried in the soil therebeneath and also permits the flap 20 to be resealed magnetically in simple fashion by repositioning the flap with the magnetic tape strips 19 aligned with the strips 19 on the liner 21.

Figure 4:
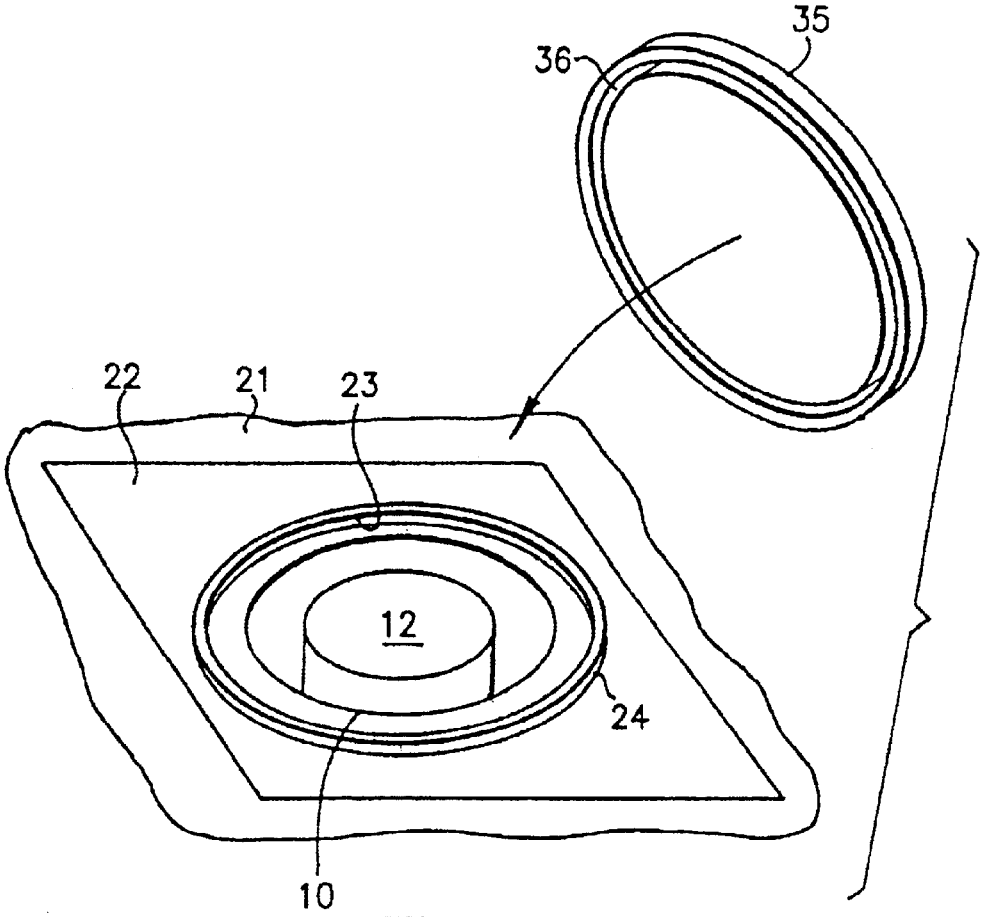
FIG. 4 is a perspective view of a resealable access patch or hatch according to yet another embodiment of the present invention, shown with the snap-on lid removed for purposes of illustration.

FIG. 4 illustrates another embodiment of an access patch 13 suitable for use according to the present invention, comprising a square patch 22 of water-resistant flexible sealing material, such as of molded plastic material formed with a control opening 23 surrounded by a molded plastic raised lip 24 configured the same as the raised lip on a "Tupperware" container. The central opening has a diameter larger than the opening 10 formed in the liner 21, to accommodate an insect control container 12 buried in the soil beneath the liner. The lip 24 of the central opening 23 in the patch 22 mates with and is sealed by a removable "Tupperware" cover 35 molded of flexible water barrier plastic material, with an outer peripheral channel 36 designed to receive and sealingly engage the mating plastic raised lip 24 of the patch 22 to provide a releasable resealable water-tight access opening to the insect control container 12.

The patch 22 is sealed to the liner 21 by means of a water-resistant adhesive and/or by means of a continuous peripheral tape, as disclosed in connection with the embodiment of FIG. 1.

Figure 5:
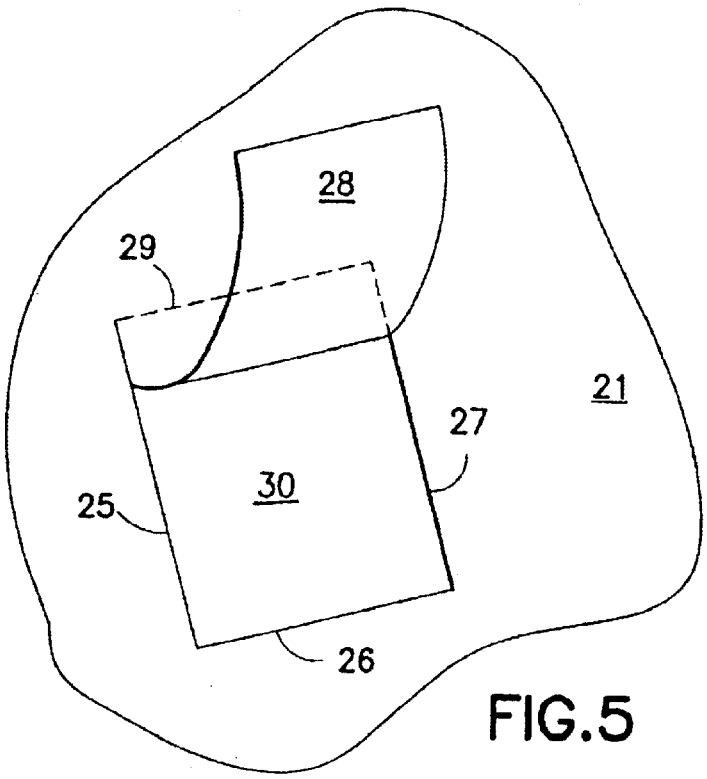
FIG. 5 is a perspective view of a preferred embodiment of the present invention in which a three-sided rectangular flap is cut into predetermined areas of the crawlspace liner, leaving the fourth side integral to provide a living hinge for the flap.
Figure 6:
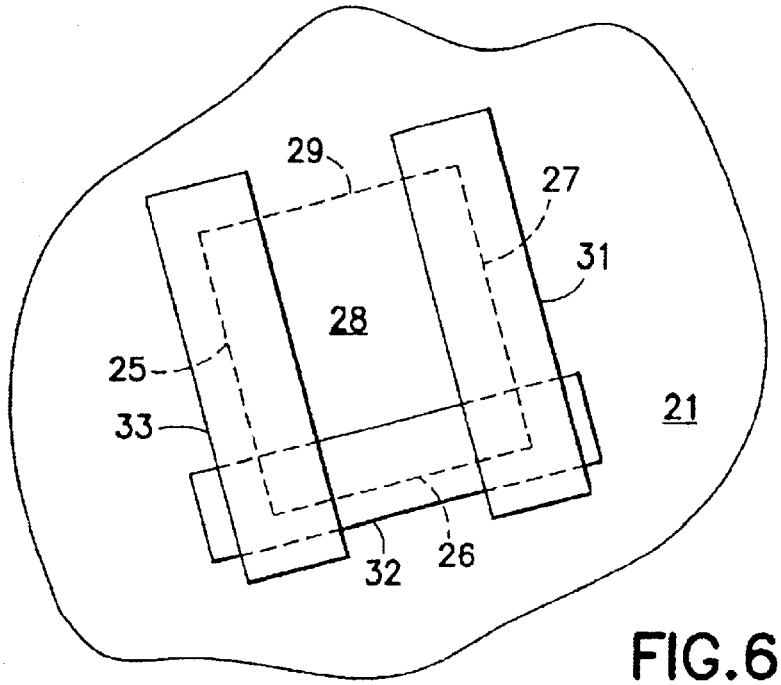
FIG. 6 is a perspective view of a preferred embodiment of the present invention in which the three-sided rectangular flap has been cut into predetermined areas of the crawlspace liner, leaving the fourth side integral to provide a living hinge for the flap, and which further illustrates the re-sealing of the cut sides of the liner flap after access has been completed, by the application of three strips of water-barrier adhesive tape over the three cut lines and overlapping the adjacent areas of the flap and of the crawlspace liner.

Referring to the preferred embodiment of FIGS. 5 and 6, predetermined areas of the liner 21, through which access is desired, are provided with three cuts 25, 26 and 27 to form a rectangular flap 28 having an integral hinge side 29. The flap 28 can be lifted to provide access to the dirt surface 30 beneath the liner 21 for any desired purpose, such as for installation or servicing or a termite-control station.

After access has been completed the water-barrier liner 21 is re-sealed in simple fashion by folding the flap 28 down over the dirt surface 30 and applying three strips of water-barrier adhesive tape 31, 32 and 33, one each over the cuts 25, 26 and 27 so as to completely cover the cuts and to overlap onto adjacent areas of the flap 28 and the water-barrier liner 21. The adhesive preferably is one which is releasable and resealable, to permit repeated access and resealing without requiring new adhesive tape strips each time.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an encapsulation system for preventing the penetration of water vapor and ground water into the crawlspace environment of a building, said crawlspace environment having a dirt floor surrounded by a substantially continuous peripheral foundation enclosing said crawlspace environment beneath the building, said system comprising a continuous sealed barrier layer covering the entire floor of the crawlspace to provide a barrier against the penetration of insects, groundwater and water vapor up through the floor and into the air space of the crawlspace, said barrier layer having vertical extensions which extend vertically up against the interior peripheral foundation to a height greater than the corresponding ground level at the exterior surface of the foundation and which are bonded to the interior peripheral foundation by a continuous seal adjacent the upper edges of said extensions to provide a continuous barrier against the penetration of exterior groundwater through said foundation and water vapor from said floor and into said crawlspace environment, the improvement which comprises at least one access opening in said liner providing access to the soil beneath the liner, each said opening comprising a flap, patch or cover which can be unsealed to expose said opening and can be resealed to restore the barrier properties of the barrier layer.

2. An encapsulation system according to claim 1 in which each said access opening in said barrier layer comprises cuts through three sides of a rectangular area of the barrier layer which form a rectangular flap having a hinged fourth side, which flap can be lifted to provide access to the soil beneath the liner, each said flap being resealable by strips of water-barrier adhesive tape present over each of said cuts, overlapping onto adjacent surface areas of the flap and of the barrier layer, to restore the water-barrier properties of the barrier layer.

3. An encapsulation system according to claim 1 in which each said access opening in said barrier layer comprises an area of the barrier layer which is cut away to form each said access opening therein, the access opening being covered with a patch of barrier layer material which is sealed to the barrier layer by means of strips of adhesive tape which overlap the edges of the patch onto the barrier layer to restore the water-barrier properties of the barrier layer.

* * * * *